US011408257B2

(12) United States Patent
Besselink et al.

(10) Patent No.: US 11,408,257 B2
(45) Date of Patent: Aug. 9, 2022

(54) METHODS FOR SUPPORTING WELLBORE FORMATIONS WITH EXPANDABLE STRUCTURES

(71) Applicant: Halliburton Energy Services, Inc., Houston, TX (US)

(72) Inventors: Peter Besselink, Enschede (NL); Wilfried Van Moorleghem, Oaxaca (MX); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 999 days.

(21) Appl. No.: 16/065,050

(22) PCT Filed: Aug. 3, 2017

(86) PCT No.: PCT/US2017/045321
§ 371 (c)(1),
(2) Date: Jun. 21, 2018

(87) PCT Pub. No.: WO2019/027462
PCT Pub. Date: Feb. 7, 2019

(65) Prior Publication Data

US 2021/0207458 A1 Jul. 8, 2021

(51) Int. Cl.
*E21B 43/10* (2006.01)
*E21B 7/28* (2006.01)
(Continued)

(52) U.S. Cl.
CPC ..... *E21B 43/105* (2013.01); *E21B 7/28* (2013.01); *E21B 33/1277* (2013.01); *E21B 43/108* (2013.01); *E21B 10/34* (2013.01)

(58) Field of Classification Search
CPC .. E21B 43/105; E21B 43/108; E21B 33/1277; E21B 7/28; E21B 10/34
See application file for complete search history.

(56) References Cited

U.S. PATENT DOCUMENTS 1,414,704 A * 5/1922 Newkirk ..... E21B 10/325 175/290
2,368,424 A * 1/1945 Reistle, Jr. ..... E21B 33/138 166/283
(Continued)

FOREIGN PATENT DOCUMENTS

WO 2007022834 A1 3/2007

OTHER PUBLICATIONS

International Search Report and Written Opinion date dated May 3, 2018, International PCT Application No. PCT/US2017/045321.

*Primary Examiner* — Jonathan Malikasim
(74) *Attorney, Agent, or Firm* — McGuireWoods LLP

(57) ABSTRACT

A method to provide support within a wellbore includes underreaming a section of the wellbore at a depth spanning a layer of an unstable formation. The method also includes deploying a bistable structure within the wellbore at the depth of the layer of the unstable formation. Additionally, the method includes actuating an expandable packer within the bistable structure to expand the bistable structure in a radially outward direction from a longitudinal axis of the bistable structure. The bistable structure is in contact with walls of the underreamed section of the wellbore upon expanding in the radially outward direction.

20 Claims, 8 Drawing Sheets

(51) Int. Cl.
*E21B 33/127* (2006.01)
*E21B 10/34* (2006.01)

(56) References Cited

U.S. PATENT DOCUMENTS

| | | | | |
|---|---|---|---|---|
| 2,382,725 | A * | 8/1945 | Koppl | E21B 10/34 175/319 |
| 2,796,134 | A * | 6/1957 | Binkley | E21B 33/127 166/207 |
| 5,842,518 | A * | 12/1998 | Soybel | E21B 43/10 166/287 |
| 5,957,225 | A | 9/1999 | Sinor | |
| 7,185,709 | B2 | 3/2007 | Schetky et al. | |
| 8,230,913 | B2 | 7/2012 | Hart et al. | |
| 8,776,876 | B2 * | 7/2014 | Hart | E21B 43/103 166/207 |
| 9,470,059 | B2 * | 10/2016 | Zhou | E21B 23/04 |
| 2005/0016740 | A1 | 1/2005 | Aldaz et al. | |
| 2009/0308616 | A1 | 12/2009 | Wylie et al. | |
| 2012/0031678 | A1 | 2/2012 | Hewson et al. | |
| 2017/0356269 | A1 * | 12/2017 | Denton | E21B 33/1208 |

* cited by examiner

METHODS FOR SUPPORTING WELLBORE FORMATIONS WITH EXPANDABLE STRUCTURES

BACKGROUND

The present disclosure relates generally to expandable devices, and more particularly to methods to use the expandable devices to support unstable sections of a geological formation.

A wellbore is often drilled proximate to a subterranean deposit of hydrocarbon resources to facilitate exploration and production of hydrocarbon resources. While drilling the wellbore, the path of a drill bit may encounter layers of unstable subterranean formations including clay and coal formations. The unstable subterranean formations have a tendency to be unstable during drilling operations typically resulting in a drilling operator moving a drill pad, at great expense, to avoid drilling through the unstable formations. By way of example, the clay formations may dissolve as an emulsion in the high pressure drilling water. When the clay dissolves, large unstable cavities develop adjacent to the wellbore. Layers of coal in the path of the drill bit also provide difficulties during the drilling operation. For example, large sections of coal can detach from walls of the wellbore during drilling. The detached sections of coal may fall into the wellbore and block the drilling shaft. Typical mechanical methods of supporting unstable sections of the borehole result in reduced wellbore diameters that limit further drilling operations downhole from the unstable sections. Chemical methods of supporting the unstable sections of the borehole (e.g., cementing the unstable sections) are prone to failure and degradation over time. Further, wellbore fluids in wells adjacent to coal formations may be highly corrosive to cement. Due to the corrosive nature of such wellbore fluid, the wellbore fluid may quickly erode any cement structures installed to support the wellbore.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the disclosed subject matter, and it is understood that other embodiments may be used and that logical structural, mechanical, electrical, and chemical changes may be made without departing from the spirit or scope of the disclosed subject matter. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The present disclosure relates to methods to provide wellbore stability within an unstable section of a wellbore. The unstable section of the wellbore may include a section of clay, coal, or other unstable material through which the wellbore is drilled. Further, the method enables drilling of the wellbore downhole from the unstable section, as the method does not decrease a diameter of the wellbore.

Figure 1A:
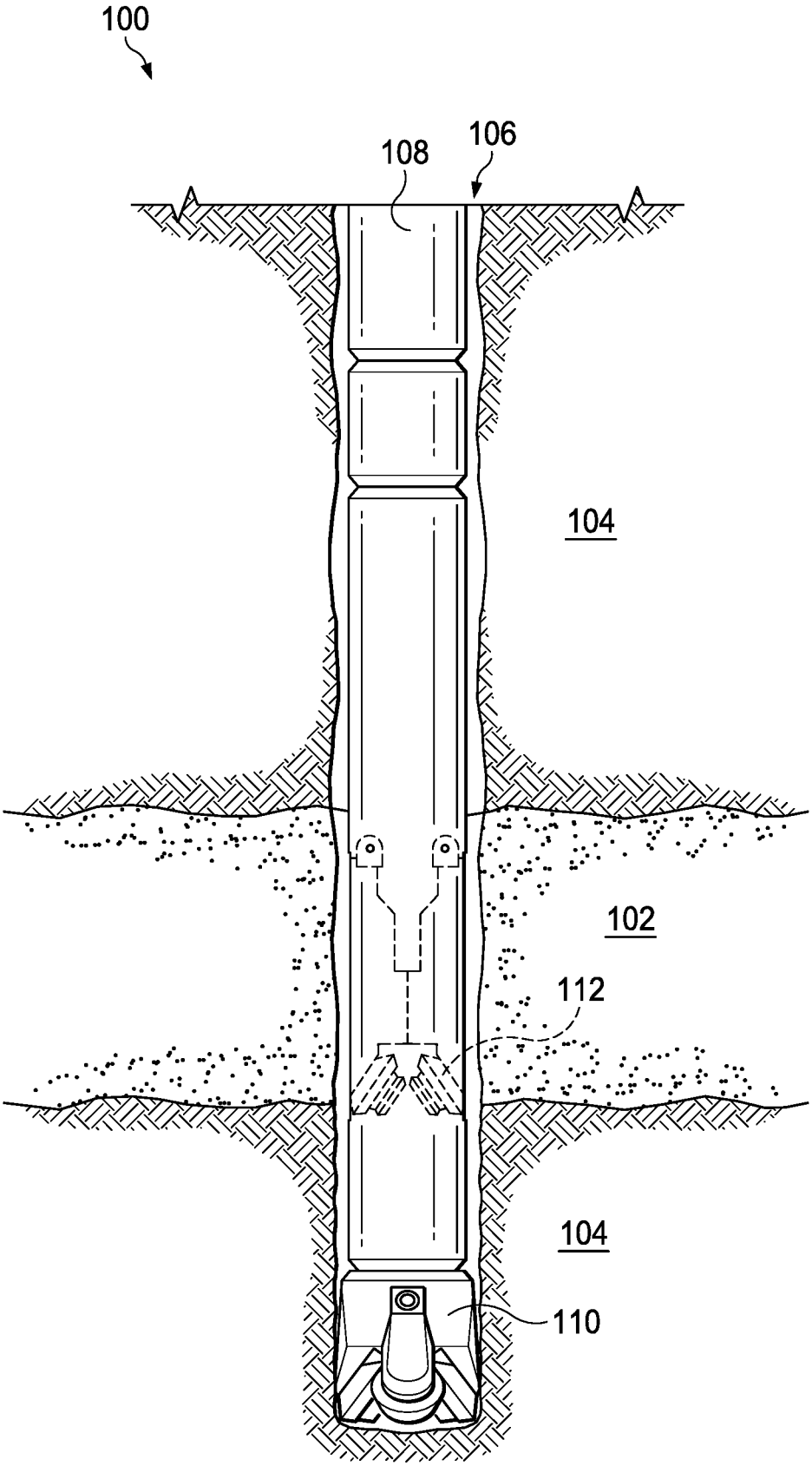
FIG. 1A is a schematic, side view of a drilling environment including a layer of an unstable formation.

Turning now to the figures, FIG. 1A is a schematic, side view of a drilling environment 100 including a layer of an unstable formation 102. The drilling environment also includes layers of a stable formation 104 and a wellbore 106, which is drilled through the layers of the stable formation 104 and the unstable formation 102. The wellbore 106 may be drilled during an onshore drilling operation or during an offshore drilling operation such as to a deep water reservoir. A drill string 108 and a drill bit 110 positioned at a downhole end of the drill string 108 provide the drilling mechanism to drill the wellbore 106.

As mentioned above, the layer of the unstable formation 102 may include a layer of clay, a layer of coal, or a layer of any other unstable formations or formation combinations. These unstable formations 102 have a tendency to be unstable during drilling operations resulting in a loss of portions of the formation 102 surrounding the wellbore 106. For example, the clay formations may dissolve as an emulsion in the high pressure drilling water. When the clay dissolves, large unstable cavities develop adjacent to the wellbore 106. Layers of coal in the path of the drill bit 110 also provide difficulties during the drilling operation. For example, large sections of coal can detach from walls of the wellbore 106 during drilling. The detached sections of coal may fall into the wellbore 106 and block the drill string 108 and the drill bit 110 from performing further drilling operations. As the drill bit 110 drills through the layer of the unstable formation 102, any further drilling absent support of the unstable formation 102 may lead to instability in the wellbore 106 and the potential loss of downhole equipment, such as the drill bit 110 and/or a portion of the drill string 108.

Figure 1B:
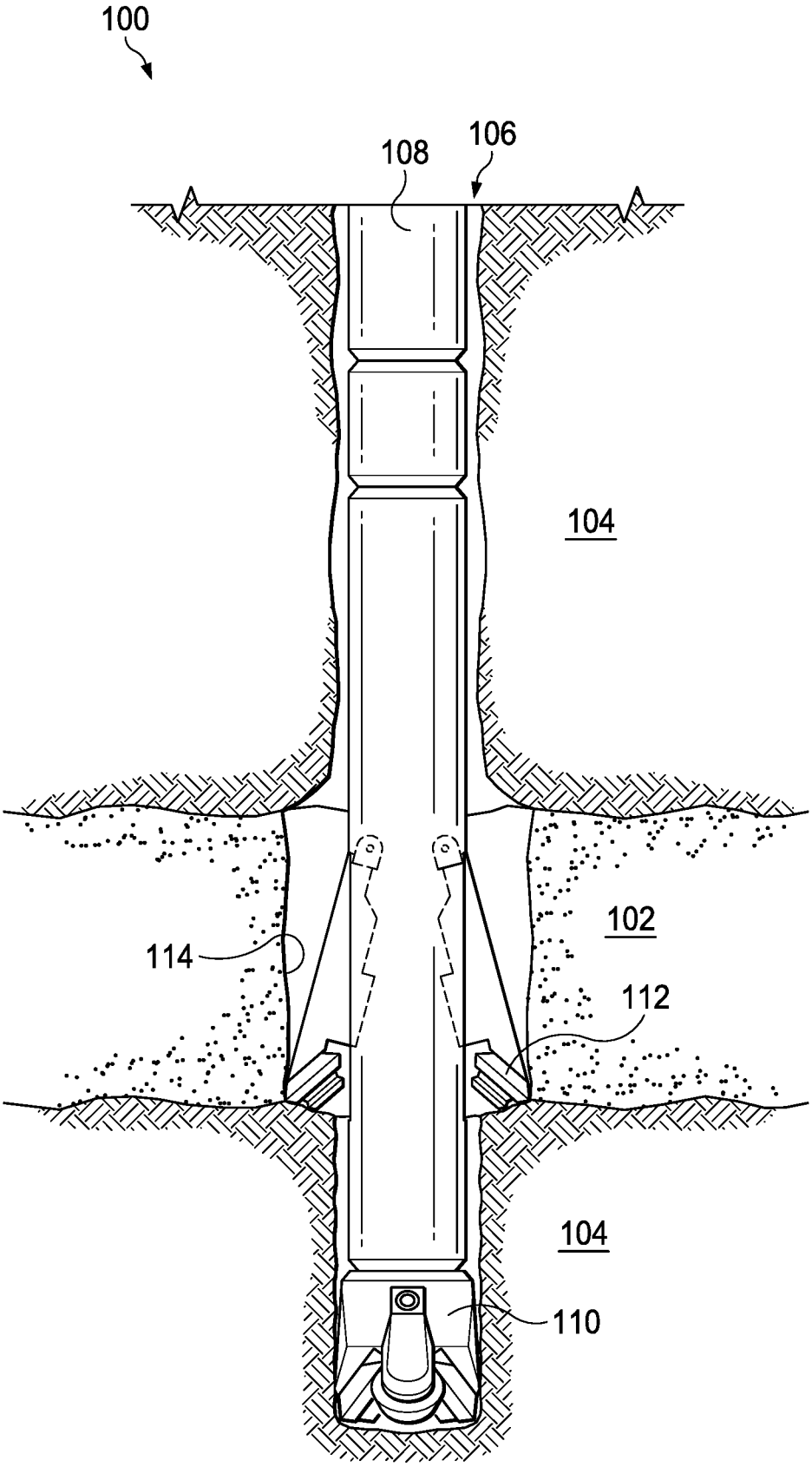
FIG. 1B is a schematic, side view of the drilling environment of FIG. 1A including an underreamed section through the layer of the unstable formation.

In an embodiment where a drilling operator is drilling in an area with a known unstable formation 102, the drilling operator may commence drilling operations with an underreamer 112 positioned along the drill string 108 uphole from the drill bit 110. The underreamer 112 provides a mechanism to underream the wellbore 106. That is, the underreamer 112 is able to expand the diameter of a section of the wellbore 106 drilled by the drill bit 110. For example, FIG. 1B is a schematic, side view of the drilling environment 100 including an underreamed section 114 through the layer of the unstable formation 102. In the illustrated embodiment, the underreamer 112 drills the underreamed section 114 after the drill bit 110 has drilled through the unstable formation 102. The underreamed section 114 may be underreamed while the drill bit 110 drills the wellbore 106 through the unstable formation 102, or the underreamed section 114 may be underreamed after the drill bit has drilled to a point downhole from the unstable formation 102 (e.g., once the drill bit 110 has drilled into the next layer of the stable formation 104).

In another embodiment, the underreamer 112 may be installed at a bottomhole end of the drill string 108 after the drill bit 110 is returned to a surface of the wellbore 106 and removed from the drill string 108. In this embodiment, the drill string 108 is removed from the wellbore after the drill bit 110 drills through the unstable formation 102, and the underreamer 112 is installed on the drill string 108. Subsequently, the underreamer 112 is run back into the wellbore 106 to make the underreaming cut that produces the underreamed section 114.

Figure 1C:
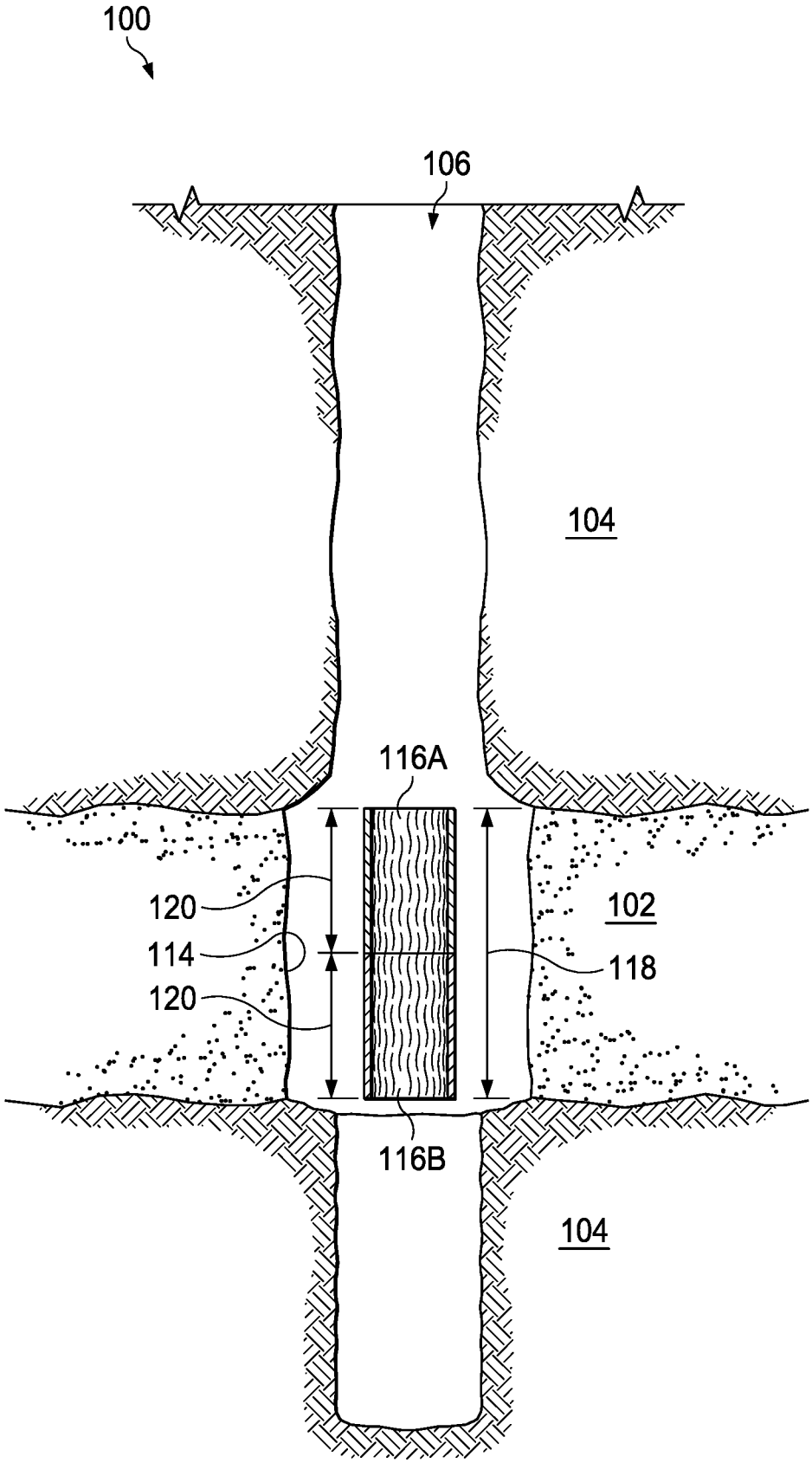
FIG. 1C is a schematic, side view of the drilling environment of FIG. 1B with a bistable structure positioned in-line with the underreamed section.

FIG. 1C is a schematic, side view of the drilling environment 100 with a bistable structure 116 positioned in-line with the underreamed section 114. In the illustrated embodiment, the bistable structure 116 includes a first section 116A and a second section 116B. In practice, the bistable structure 116 may be manufactured to a specific length, and a number of sections (e.g., 116A and 116B) are deployed within the wellbore 106. A combined length of the specified number of sections of the bistable structure 116 in an expanded state is substantially equal to a length of the underreamed section 114. For example, the underreamed section 114 may have a length 118 of twelve feet, and each of the sections 116A and 116B of the bistable structure 116 may include lengths 120 of approximately six feet when the sections 116A and 116B are in an expanded state. Accordingly, the two sections 116A and 116B may extend the length 118 of the underreamed section 114 when deployed within the wellbore 106 and actuated into the expanded state. Other lengths 118 of the underreamed section 114 and lengths 120 of the two sections 116A and 116B are also contemplated within the scope of this disclosure. Further, any number of sections of the bistable structure 116 may be deployed within the wellbore 106 to span the entire length 118 of the underreamed section 114. For example, a well drilled through a coal formation may use several hundreds of meters of the bistable structure 116 to support the wellbore 106 at locations of the unstable formation 102 (e.g., portions of the wellbore 106 drilled through layers of coal and underreamed). Additionally, when side branches are drilled, several kilometers of the bistable structure 116 may be installed within the wellbore 106. As used herein, the terms "substantially" and "approximately" indicate that a measurement is within 10 percent of the specified amount. For example, a length of approximately six feet indicates that the length may be within the range of 5.4 feet and 6.6 feet.

As used herein, the term "bistable" is defined as a component that is stable in two different states. For example, the bistable structure 116 is stable in both a collapsed state and an expanded state. That is, under normal conditions, the bistable structure 116 is able to maintain the collapsed state or the expanded state until a force acts on the bistable structure 116 to change the state. As illustrated, the sections 116A and 116B of the bistable structure 116 are in a collapsed state. The collapsed state enables a wireline, slickline, coiled tubing (wired and unwired), a downhole tractor (e.g., in a horizontal wellbore 106), or the drill string 108 to install the bistable structure 116 at a desired depth and position within the wellbore 106. For example, the collapsed state enables the bistable structure 116 to run downhole with sufficient room on either side of the bistable structure 116 to avoid becoming stuck within the wellbore 106 while being run downhole.

Figure 1D:
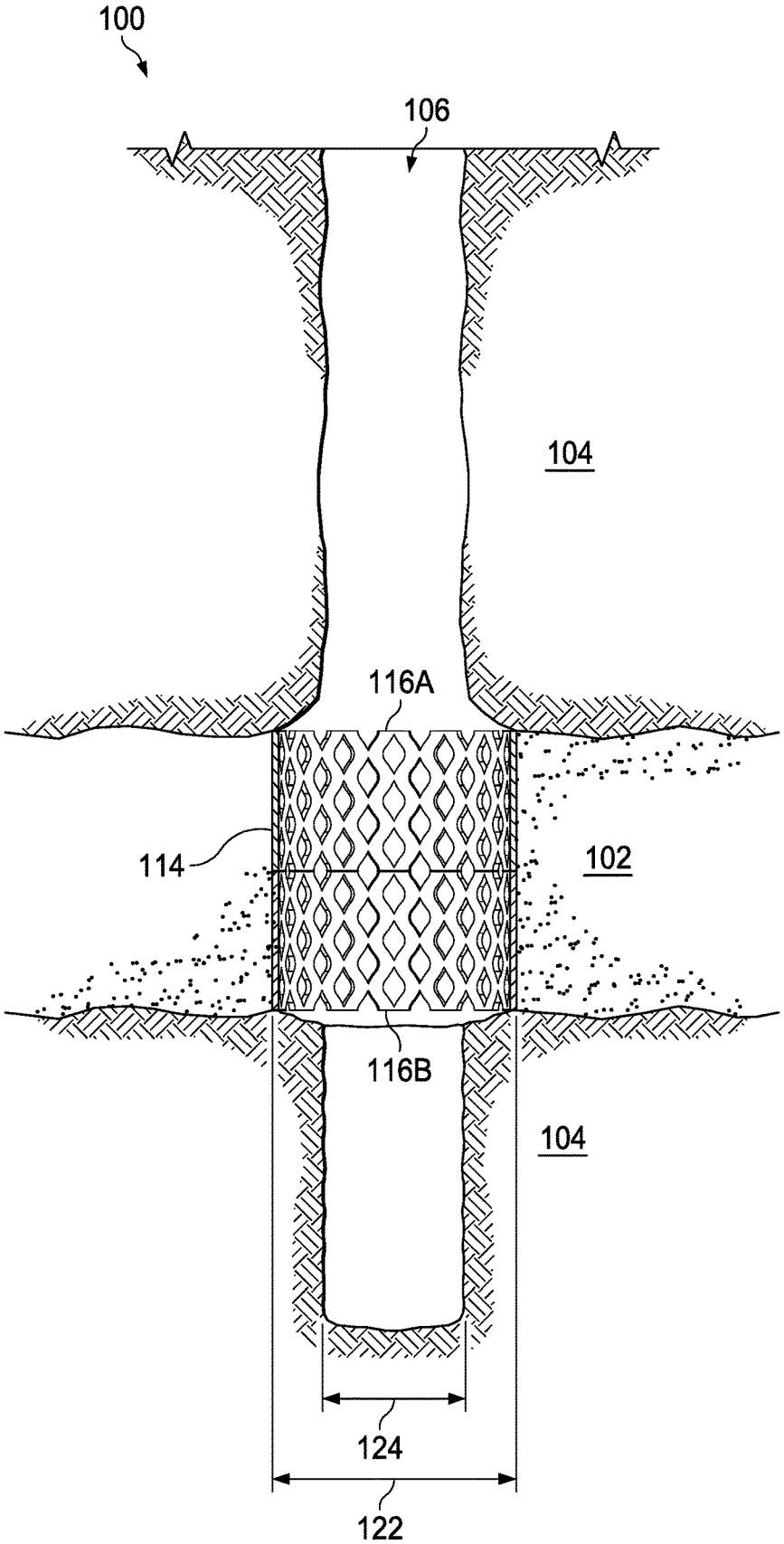
FIG. 1D is a schematic, side view of the drilling environment of FIG. 1C with the bistable structure expanded into the underreamed section.

FIG. 1D is a schematic, side view of the drilling environment 100 with the bistable structure 116 expanded into the underreamed section 114. Once the collapsed bistable structure 116, as illustrated in FIG. 1C, reaches the underreamed section 114, an expansion mechanism is run through the bistable structure 116. The expansion mechanism (not shown) may include an expandable packer or other device that provides a radially outward force on an inner portion of the bistable structure 116 toward the walls of the wellbore 106. By expanding the bistable structure 116, the bistable structure 116 is secured within the underreamed section 114 of the wellbore 106. Further, because a diameter 122 of the underreamed section 114 of the wellbore 106 is larger than a diameter 124 of a remainder of the wellbore 106, the bistable structure 116 in an expanded state fits within the underreamed section 114 without blocking the wellbore 106. For example, in the illustrated embodiment, the diameter 122 of the underreamed section 114 may be larger than the diameter 124 of the remainder of the wellbore 106 by an amount equal to two times a thickness of a wall of the bistable structure 116. In this manner, an interior wall of the bistable structure 116, while in the expanded state, sits flush with a wall of the wellbore 106. In another embodiment, the diameter 122 may be sufficiently larger than the diameter 124 such that the bistable structure 116 is expandable radially outward to a position that provides sufficient clearance for downhole tools to pass unimpeded through an interior of the bistable structure 116. That is, while an interior wall of the bistable structure is not flush with the wall of the wellbore 106, sufficient clearance is still provided to enable passage of drilling equipment further downhole in the wellbore 106.

With the bistable structure 116 expanded radially outward, stability is provided to the layer of the unstable formation 102 through which the wellbore 106 is drilled. For example, the bistable structure 116 may prevent pieces of coal or other unstable material from falling downhole during drilling operations performed downhole from the unstable formation 102. In an embodiment, a high expansion mesh layer may be added to an outer wall of the bistable structure 116, and the high expansion mesh layer may prevent smaller pieces of the unstable formation 102 from falling downhole in the wellbore 106. In another embodiment, the bistable structure 116 may be coated with a liquid impermeable material to prevent wellbore fluids from interacting with the unstable formation 102, such as a layer of clay. In this manner, the clay within the unstable formation 102 is not washed away with the wellbore fluid and the integrity of the wellbore 106 remains intact.

Figure 1E:
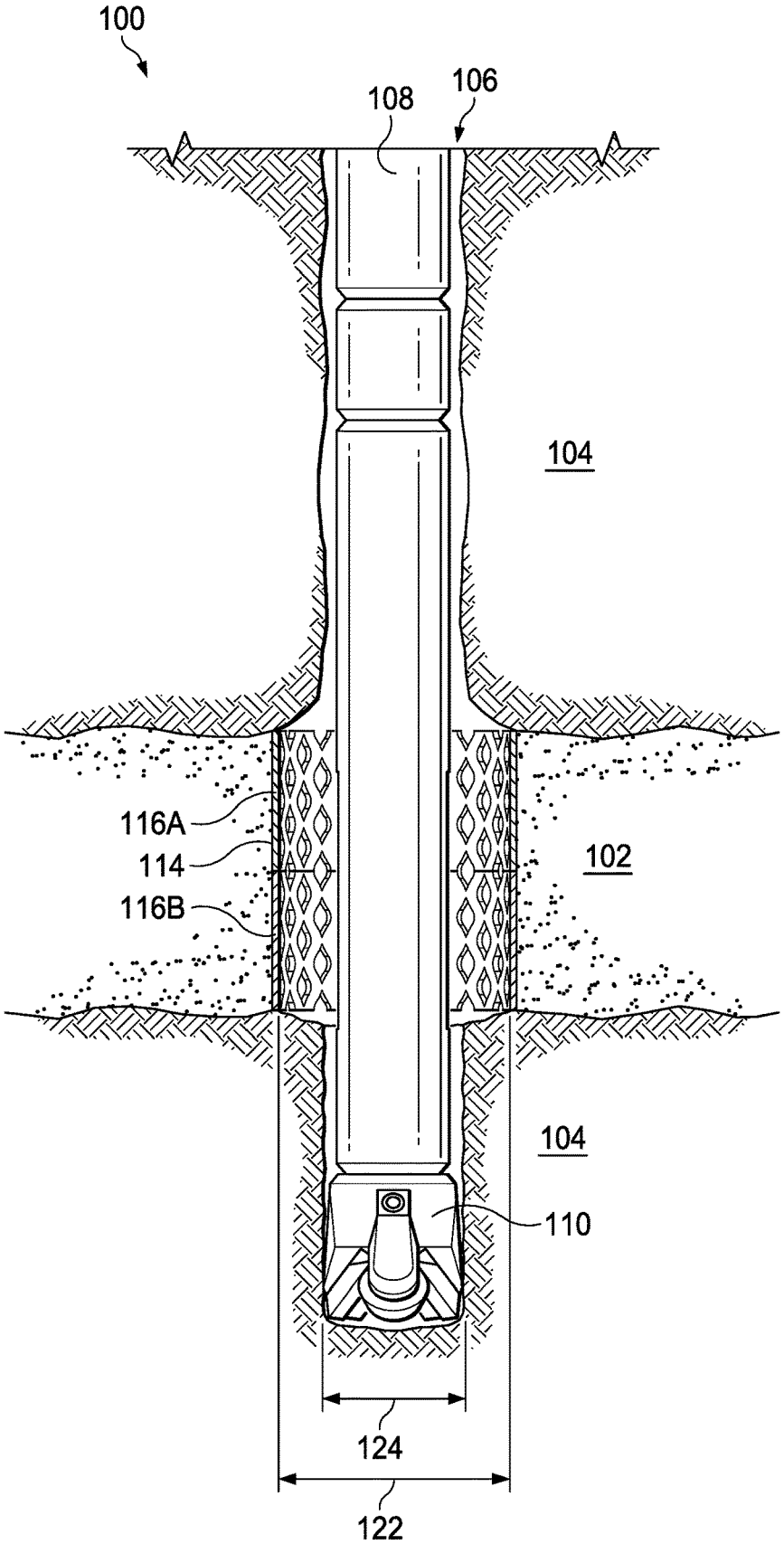
FIG. 1E is a schematic, side view of the drilling environment of FIG. 1D upon recommencement of drilling downhole from the underreamed section.

FIG. 1E is a schematic, side view of the drilling environment 100 upon recommencement of drilling operations downhole from the underreamed section 114. Once the bistable structure 116 is installed within the underreamed section 114, the wellbore 106 is clear to recommence drilling downhole from the unstable formation 102 as the bistable structure 116 provides support to the layer of the unstable formation 102. Additionally, the drill bit 110, or any other downhole tools, are able to run through the bistable structure 116 due to an inner diameter 126 of the bistable structure 116 in the expanded state being similar to the diameter 124 of the wellbore 106. This process illustrated in FIGS. 1A-1E may be repeated if another layer of the unstable formation 102 is encountered during drilling further downhole within the wellbore 106.

Figure 2A:
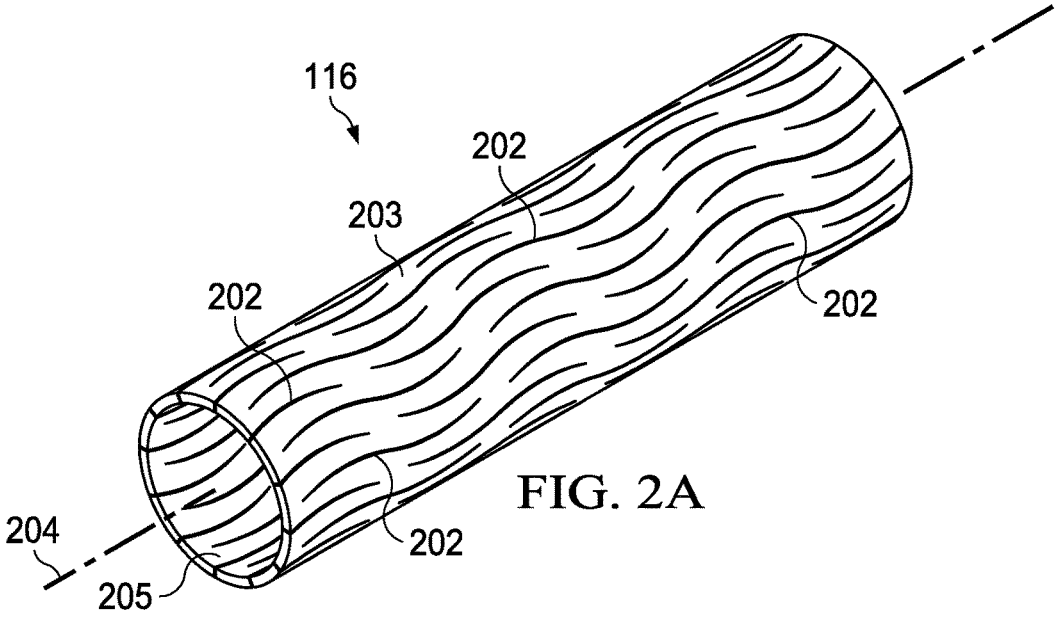
FIG. 2A is a perspective view of the bistable structure of FIG. 1C in a collapsed state.

FIG. 2A is a perspective view of the bistable structure 116 of FIG. 1C in a collapsed state. The bistable structure 116 in the collapsed state is insertable into the wellbore 106 at a depth of the underreamed section 114 in the wellbore 106. Perforations 202 of the bistable structure 116 pierce a shell the bistable structure 116 from an outer surface 203 to an inner surface 205 of the bistable structure 116. The perforations 202 generally extend along the bistable structure 116 in a direction parallel to a longitudinal axis 204. The perforations 202 enable the bistable structure 116 to expand radially outward from the longitudinal axis 204. Upon expansion of the bistable structure 116, the bistable structure 116 is able to provide support to unstable formation 102 within the wellbore 106.

Figure 2B:
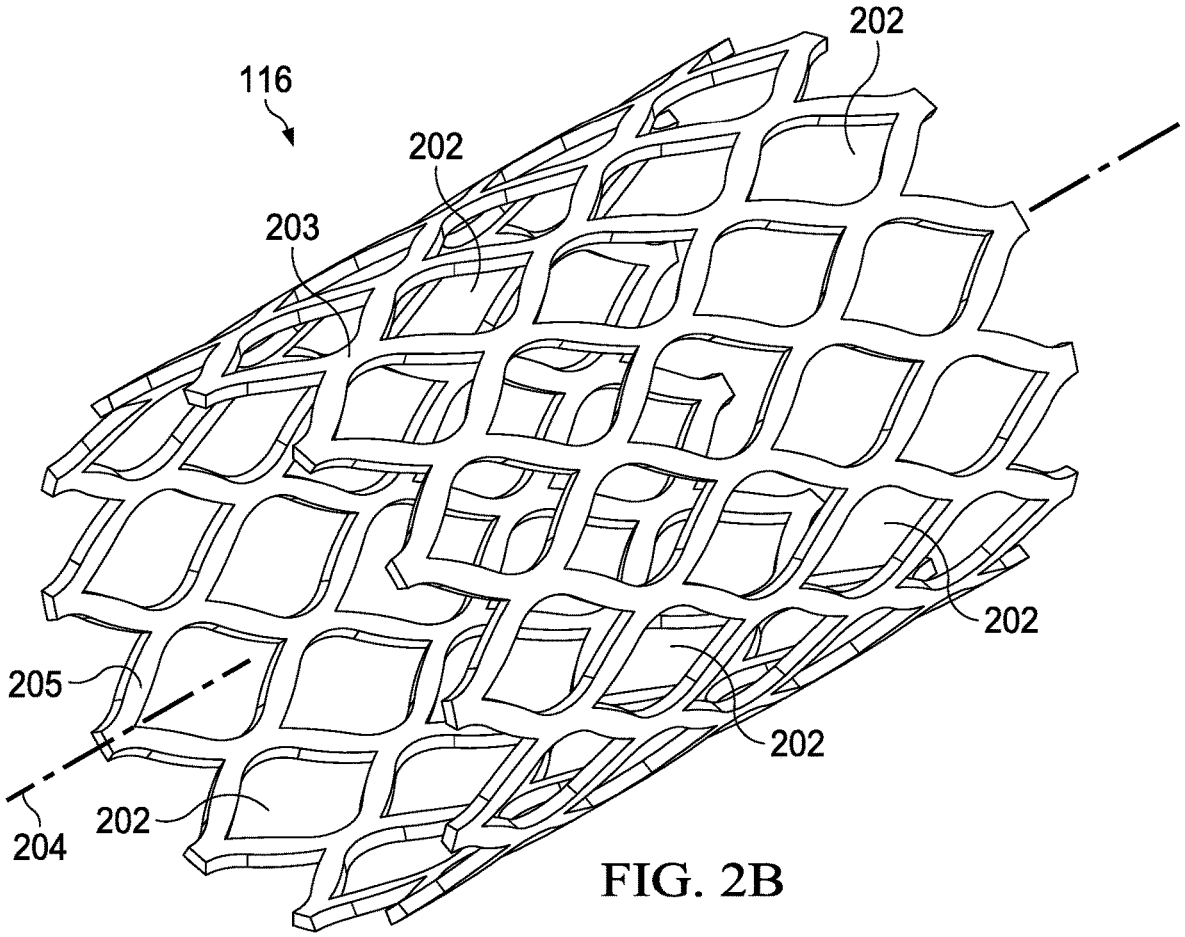
FIG. 2B is a perspective view of the bistable structure of FIG. 2A in an expanded state.

FIG. 2B is a perspective view of the bistable structure 116 in an expanded state. The perforations 202 expand into a diamond shape as the bistable structure 116 expands radially outward from the longitudinal axis 204. To expand the bistable structure 116 from the collapsed state, an expansion pressure of approximately 300 psi is provided on the inner surface 205 of the bistable structure 116. The expansion pressure may be provided by an expandable packer or any other expansion device capable of providing the sufficient expansion pressure. Further, upon expansion of the bistable structure 116, the bistable structure 116 may be maintained in the expanded state while a contraction force of up to 290 psi acts on the outer surface 203 of the bistable structure 116. Other expansion and contraction forces for the bistable structure 116 are also contemplated within the scope of this disclosure.

Figure 3A:
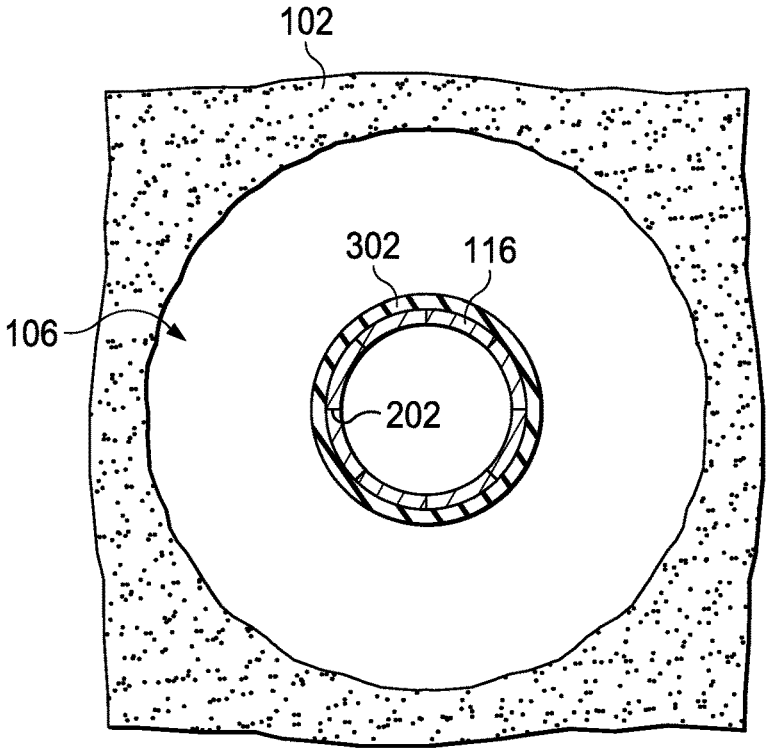
FIG. 3A is a sectional view of the bistable structure of FIG. 2A in the collapsed state within a wellbore.

FIG. 3A is a sectional view of the bistable structure 116 in the collapsed state within a wellbore 106. In an embodiment, the bistable structure 116 includes a sealing layer 302. The sealing layer 302 may be made from an elastomeric material to block wellbore fluids from interacting with the unstable formation 102 when the bistable structure 116. In another embodiment, the sealing layer 302 may be made from a mesh material that provides a high expansion screen that allows fluid flow while preventing solid pieces of the unstable formation 102 from falling downhole in the wellbore 106. An elastomeric sealing layer 302 may be suited for installation around the bistable structure 116 when the bistable structure 116 supports a layer of clay. A mesh material sealing layer 302 may be suited for installation around the bistable structure 116 when the bistable structure 116 supports a layer of coal. However, it is contemplated that both the elastomeric sealing layer 302 and the mesh material sealing layer 302 may be deployed individually around the bistable structure 116 to provide adequate support of the unstable formation 102 when the unstable formation 102 is coal, clay, or any other unstable formation. In either embodiment, the sealing layer 302 is able to expand with the bistable structure 116 as the bistable structure 116 transitions from the collapsed state to the expanded state.

In another embodiment, the sealing layer 302 includes both the elastomeric material and a reinforcing mesh. The elastomeric material is made from swellable or nonswellable elastomer that is glued, injection molded, sprayed on, or otherwise connected to a woven, knitted, or welded reinforcing mesh. The reinforcing mesh, which can be made from one or more of several oil and gas compatible materials, acts as a reinforcing layer that enables the sealing layer 302 to span large gaps of the perforations 202 of the bistable structure 116 in the expanded state.

The elastomeric material may be made from a swellable rubber such that any elastic recoil in the bistable structure 116 will be filled by the swellable rubber. The elastomeric material may also be made from a non-swellable rubber. In such an embodiment, a sealing surface of the elastomeric material may be textured, such as with circumferential ridges, to accommodate any elastic recoil. Alternatively, the sealing surface of the elastomeric material may also be smooth. In another embodiment, the elastomeric material is made from a plastic material.

Figure 3B:
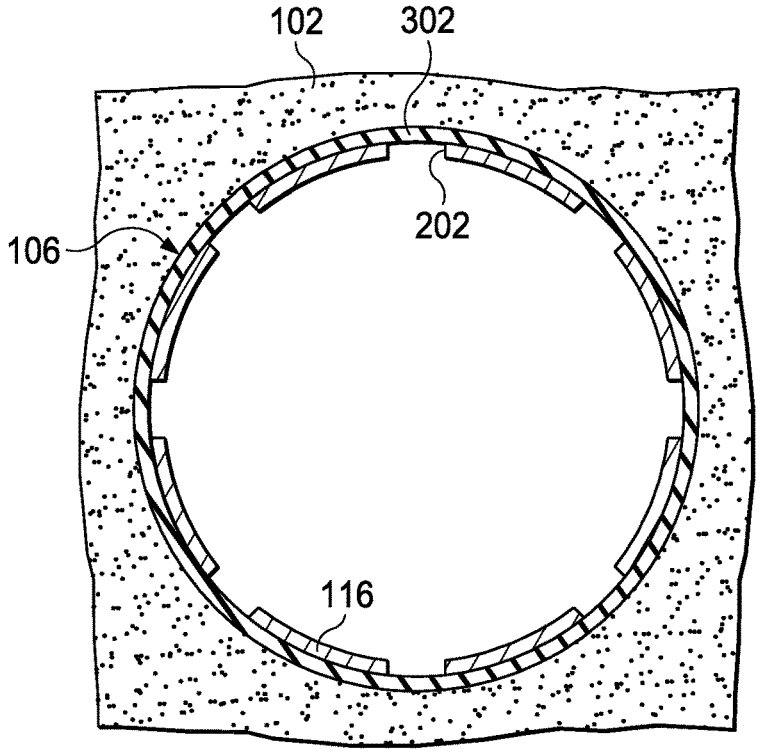
FIG. 3B is a sectional view of the bistable structure of FIG. 2B in the expanded state within the wellbore.

FIG. 3B is a sectional view of the bistable structure 116 in the expanded state within the wellbore 106. In the illustrated embodiment, gaps from the perforations 202 are present. Accordingly, the sealing layer 302 may prevent formation material from the unstable formation 102 from entering the wellbore 106 and/or wellbore fluids from interacting with the formation material of the unstable formation 102. In other embodiments, where wellbore fluid interaction with the unstable formation 102 is not an issue, the sealing layer 302 may not be included around the bistable structure 116, and the bistable structure 116 directly supports the unstable formation 102. An absence of the sealing layer 302 may be particularly suited for unstable formations 102 that are not prone to washing away or breaking apart in small pieces.

Figure 4:
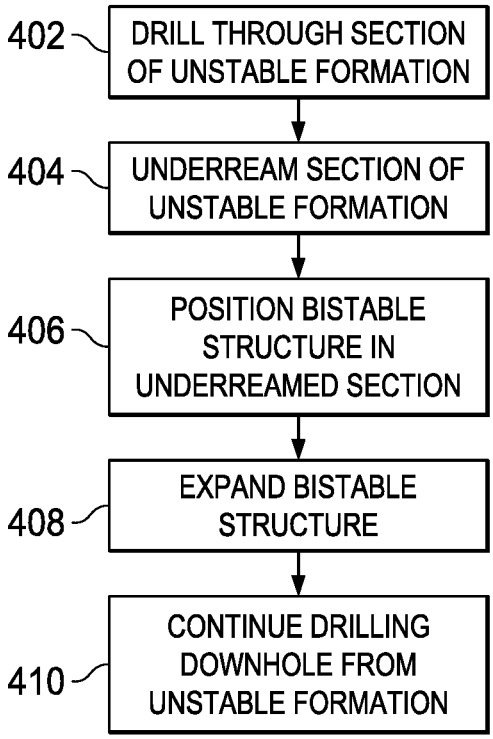
FIG. 4 is a block diagram of a process for installing the bistable structure of FIG. 2 within the wellbore.

FIG. 4 is a block diagram of a process 400 for installing the bistable structure 116 within the wellbore 106. Initially, at block 402, the drill bit 110 drills the wellbore 106 through the layer of the unstable formation 102. The wellbore 106 may be drilled during an onshore drilling operation or an offshore drilling operation.

As mentioned above with respect to FIG. 1, the layer of the unstable formation 102 may include a layer of clay, a layer of coal, or a layer of any other unstable formations or formation combinations. Theses unstable formations 102 have a tendency for instability during drilling operations. For example, the clay formations may dissolve as an emulsion in the high pressure drilling water. When the clay dissolves, large unstable cavities develop adjacent to the wellbore 106. Layers of coal in the path of the drill bit 110 also provide difficulties during the drilling operation. For example, large sections of coal can detach from walls of the wellbore 106 during drilling. The detached sections of coal may fall into the wellbore 106 and block the drill string 108 and the drill bit 110 from performing further drilling operations. As the drill bit 110 drills through the layer of the unstable formation 102, any further drilling absent support of the unstable formation 102 may lead to instability in the wellbore 106 and the potential loss of downhole equipment, such as the drill bit 110 and/or a portion of the drill string 108.

At block 404, the layer of the unstable formation 102 is underreamed at a depth within the wellbore 106 spanning the unstable formation 102. The drilling operator may commence drilling operations with an underreamer 112 positioned uphole from the drill bit 110. The underreamer 112 provides a mechanism to underream the wellbore 106. That is, the underreamer 112 is able to expand the diameter of a section of the wellbore 106 drilled by the drill bit 110. At block 404, the underreamer 112 may drill the underreamed section 114 after the drill bit 110 has completely drilled through the unstable formation 102, or the underreamed section 114 may be underreamed while the drill bit 110 drills the wellbore 106 through the unstable formation 102. In another embodiment, the underreamer 112 may be installed at a bottomhole end of the drill string 108 after the drill bit 110 is removed from the drill string 108. In this embodiment, the drill string 108 is removed from the wellbore after the drill bit 110 drills through the unstable formation 102, and the underreamer 112 is installed on the drill string 108 and run back into the wellbore 106 to make the underreaming cut that produces the underreamed section 114.

After underreaming the underreamed section 114, at block 406, the bistable structure 116 is positioned within the wellbore 106 at a depth that is in-line with the underreamed section 114. In an embodiment, the bistable structure 116 may include multiple sections such that the bistable structure 116 extends for an entire length 118 of the underreamed section 114. In practice, the bistable structure 116 may be manufactured to a specific length, and a number of sections whose lengths add up to a length of the underreamed section 114 are deployed within the wellbore 106. For example, the underreamed section 114 may have a length 118 of twelve feet, and each of the sections 116A and 116B of the bistable structure may include lengths 120 of approximately six feet when the sections 116A and 116B are in the expanded state. In this manner, the two sections 116A and 116B may extend the length 118 of the underreamed section 114 when deployed within the wellbore 106. Other lengths 118 of the underreamed section 114 and lengths 120 of the two sections 116A and 116B are also contemplated within the scope of this disclosure. Further, any number of sections of the bistable structure 116 may be deployed within the wellbore 106 to span the entire length 118 of the underreamed section 114.

Additionally, the bistable structure 116 is run into the wellbore 106 using a wireline, a slickline, coiled tubing (wired and unwired), a downhole tractor (e.g., in a horizontal wellbore 106), or the drill string 108 to install the bistable structure 116 at a desired position within the wellbore 106. The collapsed state of the bistable structure 116 enables the bistable structure 116 to run downhole with sufficient room on either side of the bistable structure 116 to avoid becoming stuck within the wellbore 106 while being run downhole.

Once the bistable structure 116 is in position within the wellbore 106, the bistable structure 116 is expanded to fit against the walls of the underreamed section 114 at block 408. When the collapsed bistable structure 116 reaches the underreamed section 114, an expansion mechanism is expanded from within the bistable structure 116 or run through the bistable structure 116. The expansion mechanism may include an expandable packer (e.g., using a hydraulic actuator) positioned within the bistable structure 116, a mechanical device (e.g., a cone) run through the bistable structure 116, or any combination thereof that provides a radially outward force on an inner surface of the bistable structure 116 toward the walls of the wellbore 106. By expanding the bistable structure 116, the bistable structure 116 is secured within the underreamed section 114 of the wellbore 106. Further, because a diameter 122 of the underreamed section 114 of the wellbore 106 is larger than a diameter 124 of a remainder of the wellbore 106, the bistable structure 116 in an expanded state fits within the underreamed section 114 without blocking the wellbore 106. For example, in the embodiment illustrated in FIG. 1D, the diameter 122 of the underreamed section 114 may be larger than the diameter 124 of the remainder of the wellbore 106 by an amount equal to two times a thickness of a wall of the bistable structure 116. In this manner, an interior wall of the bistable structure 116, while in the expanded state, sits flush with a wall of the wellbore 106. In another embodiment, the diameter 122 may be sufficiently larger than the diameter 124 such that the bistable structure 116 is expandable radially outward to a position that provides sufficient clearance for downhole tools to pass unimpeded through an interior of the bistable structure 116.

At block 410, drilling of the wellbore 106 is recommenced downhole from the bistable structure 116 and the unstable formation 102. Once the bistable structure 116 is installed within the underreamed section 114, the wellbore 106 is clear to recommence drilling downhole from the unstable formation 102 as the bistable structure 116 provides support to the layer of the unstable formation 102. Additionally, the drill bit 110, or any other downhole tools, are able to run through the bistable structure 116 due to an inner diameter 126 of the bistable structure 116 in the expanded state being similar to the diameter 124 of the wellbore 106. The process 400 may be repeated if another layer of the unstable formation 102 is encountered during drilling further downhole within the wellbore 106.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a method to provide support within a wellbore, comprising: underreaming a section of the wellbore at a depth spanning a layer of an unstable formation; deploying a bistable structure within the wellbore at the depth of the layer of the unstable formation; and actuating an expandable packer within the bistable structure to expand the bistable structure in a radially outward direction from a longitudinal axis of the bistable structure, wherein the bistable structure is in contact with walls of the underreamed section of the wellbore upon expanding in the radially outward direction.

Clause 2, the method of clause 1, wherein underreaming the section of the wellbore is performed by an underreamer while a downhole portion of the wellbore is drilled by a drill bit.

Clause 3, the method of clause 1 or 2, comprising: drilling the wellbore with a drill bit to a location downhole from the depth of the layer of the unstable formation; and replacing the drill bit with an underreamer to underream the section of the wellbore spanning the depth of the layer of the unstable formation.

Clause 4, the method of any one of clauses 1-3, wherein actuating the expandable packer comprises actuating a hydraulic pump to expand the expandable packer within the bistable structure.

Clause 5, the method of at least one of clauses 1-4, wherein the bistable structure comprises a sealing layer as an outer surface of the bistable structure, and, upon expansion of the bistable structure, the sealing layer is in contact with the walls of the underreamed section of the wellbore.

Clause 6, the method of clauses 5, wherein the sealing layer comprises a mesh material or an elastomeric material.

Clause 7, the method of at least one of clauses 1-6, comprising drilling the wellbore downhole from the bistable structure upon expansion of the bistable structure within the underreamed section of the wellbore.

Clause 8, the method of at least one of clauses 1-7, comprising: underreaming a second section of the wellbore at a second depth spanning a second layer of the unstable formation; deploying a second bistable structure within the wellbore at the second depth; and actuating a second expandable packer within the second bistable structure to expand the second bistable structure in the radially outward direction from a second longitudinal axis of the second bistable structure, wherein the second bistable structure is in contact with walls of the second section of the wellbore upon expanding in the radially outward direction.

Clause 9, wherein the bistable structure comprises at least two independent sections, and a combined length of the at least two independent sections is substantially equal to a length of the underreamed section of the wellbore.

Clause 10, the method of at least one of clauses 1-9, wherein underreaming the section of the wellbore comprises cutting into a wall of the wellbore to expand a diameter of the wellbore by an amount equal to two times a thickness of a wall of the bistable structure.

Clause 11, a method comprising: drilling a wellbore through a layer of an unstable formation; underreaming a section of the wellbore at the layer of the unstable formation; positioning a bistable structure in a collapsed state at a depth of the underreamed section of the wellbore; expanding the bistable structure to an expanded state, wherein the bistable structure is in contact with the underreamed section of the wellbore upon expansion of the bistable structure; and drilling downhole from the layer of the unstable formation.

Clause 12, the method of clause 11, comprising: underreaming a second section of the wellbore at a second layer of the unstable formation; positioning a second bistable structure in the collapsed state at a second depth of the second underreamed section of the wellbore; and expanding the second bistable structure to the expanded state, wherein the second bistable structure is in contact with the second underreamed section of the wellbore upon expansion of the second bistable structure.

Clause 13, the method of at least one of clauses 11 or 12, wherein expanding the bistable structure to the expanded state comprises actuating an expandable packer positioned within the bistable structure.

Clause 14, the method of clauses 11-13, wherein the bistable structure comprises a sealing layer configured to prevent portions of the unstable formation from entering the wellbore.

Clause 15, the method of clause 14, wherein the sealing layer comprises a mesh material or an elastomeric material that is compatible with wellbore fluids.

Clause 16, the method of clauses 11-15, wherein underreaming the section of the wellbore is performed simultaneously with drilling the wellbore.

Clause 17, the method of clauses 11-16, wherein positioning the bistable structure in the collapsed state at the depth of the underreamed section of the wellbore is accomplished using a wireline.

Clause 18, a system to support an unstable formation in a wellbore, comprising: a bistable structure, wherein the bistable structure is configured to expand within an underreamed portion the wellbore from a collapsed state to an expanded state, and the bistable structure is stable in both the collapsed state and the expanded state; and a sealing layer positioned around the bistable structure, the sealing layer configured to prevent debris from the unstable formation from entering the wellbore.

Clause 19, the system of clause 18, wherein the sealing layer comprises a mesh that prevents passage of solids from the unstable formation into the wellbore.

Clause 20, the system of at least one of clauses 18 or 19, wherein the sealing layer comprises an elastomeric material that prevents contact between wellbore fluids and the unstable formation.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

It should be apparent from the foregoing that embodiments of an invention having significant advantages have been provided. While the embodiments are shown in only a few forms, the embodiments are not limited but are susceptible to various changes and modifications without departing from the spirit thereof

What is claimed is:

1. A method to provide support within a wellbore, comprising:

underreaming a section of the wellbore with an underreamer at a depth spanning a layer of an unstable formation simultaneously with the drilling of a downhole portion of the wellbore such that the underreaming occurs while a drill bit is cutting through the downhole portion of the wellbore; wherein the underreamer is positioned uphole of the drill bit on a drill string;

deploying a bistable structure within the wellbore at the depth of the layer of the unstable formation; and actuating an expandable packer within the bistable structure to expand the bistable structure in a radially outward direction from a longitudinal axis of the bistable structure, wherein the bistable structure comprises a sealing layer as an outer surface of the bistable structure, wherein the sealing layer is in contact with walls of the underreamed section of the wellbore upon expanding in the radially outward direction, wherein the sealing layer comprises a swellable elastomeric material and a reinforcing mesh, and wherein the elastomeric material is connected to the reinforcing mesh; wherein the reinforcing mesh acts as a reinforcing layer that enables the sealing layer to span large gaps of perforations of the bistable structure when in an expanded state; wherein the swellable elastomeric material swells such that elastic recoil in the bistable structure is filled by the swellable elastomeric material.

2. The method of claim 1, wherein actuating the expandable packer comprises actuating a hydraulic pump to expand the expandable packer within the bistable structure.

3. The method of claim 1, comprising drilling the wellbore downhole from the bistable structure upon expansion of the bistable structure within the underreamed section of the wellbore.

4. The method of claim 1, comprising:

underreaming a second section of the wellbore at a second depth spanning a second layer of the unstable formation;

deploying a second bistable structure within the wellbore at the second depth; and actuating a second expandable packer within the second bistable structure to expand the second bistable structure in the radially outward direction from a second longitudinal axis of the second bistable structure, wherein the second bistable structure is in contact with walls of the second section of the wellbore upon expanding in the radially outward direction.

5. The method of claim 1, wherein the bistable structure comprises at least two independent sections, and a combined length of the at least two independent sections is substantially equal to a length of the underreamed section of the wellbore.

6. The method of claim 1, wherein underreaming the section of the wellbore comprises cutting into the wall of the wellbore to expand a diameter of the wellbore by an amount equal to two times a thickness of a wall of the bistable structure.

7. A method comprising:

drilling a wellbore through a layer of an unstable formation;

underreaming a section of the wellbore with an underreamer at the layer of the unstable formation simultaneously with the drilling of a downhole portion of the wellbore such that the underreaming occurs while a drill bit is cutting through the downhole portion of the wellbore; wherein the underreamer is positioned uphole of the drill bit on a drill string;

positioning a bistable structure in a collapsed state at a depth of the underreamed section of the wellbore;

expanding the bistable structure to an expanded state, wherein the bistable structure comprises a sealing layer as an outer surface of the bistable structure, wherein the sealing layer is in contact with the underreamed section of the wellbore upon expansion of the bistable structure wherein the sealing layer comprises a swellable elastomeric material and a reinforcing mesh, and wherein the elastomeric material is connected to the reinforcing mesh; wherein the reinforcing mesh acts as a reinforcing layer that enables the sealing layer to span large gaps of perforations of the bistable structure when in the expanded state; wherein the swellable elastomeric material swells such that elastic recoil in the bistable structure is filled by the swellable elastomeric material; and drilling downhole from the layer of the unstable formation.

8. The method of claim 7, comprising:

underreaming a second section of the wellbore at a second layer of the unstable formation;

positioning a second bistable structure in the collapsed state at a second depth of the second underreamed section of the wellbore; and expanding the second bistable structure to the expanded state, wherein the second bistable structure is in contact with the second underreamed section of the wellbore upon expansion of the second bistable structure.

9. The method of claim 7, wherein expanding the bistable structure to the expanded state comprises actuating an expandable packer positioned within the bistable structure.

10. The method of claim 9, wherein actuating the expandable packer comprises actuating a hydraulic pump to expand the expandable packer within the bistable structure.

11. The method of claim 7, wherein the sealing layer is configured to prevent portions of the unstable formation from entering the wellbore.

12. The method of claim 7, wherein positioning the bistable structure in the collapsed state at the depth of the underreamed section of the wellbore is accomplished using a wireline.

13. The method of claim 7, wherein the bistable structure comprises at least two independent sections, and a combined length of the at least two independent sections is substantially equal to a length of the underreamed section of the wellbore.

14. The method of claim 7, wherein underreaming the section of the wellbore comprises cutting into a wall of the wellbore to expand a diameter of the wellbore by an amount equal to two times a thickness of a wall of the bistable structure.

15. A system to support an unstable formation in a wellbore, comprising:

an underreamer configured to underream a section of the wellbore at a depth spanning a layer of the unstable formation simultaneously with the drilling of a downhole portion of the wellbore such that the underreaming occurs while a drill bit is cutting through the downhole portion of the wellbore; wherein the underreamer is positioned uphole of the drill bit on a drill string;

a bistable structure, wherein the bistable structure is configured to expand within an underreamed section of the wellbore from a collapsed state to an expanded state, and the bistable structure is stable in both the collapsed state and the expanded state; and a sealing layer positioned around the bistable structure, the sealing layer configured to prevent debris from the unstable formation from entering the wellbore; wherein the sealing layer is an outer surface of the bistable structure, wherein the sealing layer is configured to be in contact with the underreamed section of the wellbore upon expansion of the bistable structure; wherein the sealing layer comprises a swellable elastomeric material and a reinforcing mesh, and wherein the elastomeric material is connected to the reinforcing mesh; wherein the reinforcing mesh acts as a reinforcing layer that enables the sealing layer to span large gaps of perforations of the bistable structure when in the expanded state; wherein the swellable elastomeric material swells such that elastic recoil in the bistable structure is filled by the swellable elastomeric material.

16. The system of claim 15, wherein the sealing layer prevents passage of solids from the unstable formation into the wellbore.

17. The system of claim 15, wherein the sealing layer prevents contact between wellbore fluids and the unstable formation.

18. The method of claim 15, further comprising positioning the bistable structure in the collapsed state at the depth of the underreamed section by using a wireline.

19. The system of claim 15, further comprising an expandable packer positioned within the bistable structure and configured to expand the bistable structure to the expanded state upon actuation.

20. The system of claim 19, further comprising a hydraulic pump configured to actuate the expandable packer.

* * * * *